United States Patent [19]

Caspe

[11] Patent Number: 4,793,105

[45] Date of Patent: Dec. 27, 1988

[54] EARTHQUAKE PROTECTION SYSTEM

[76] Inventor: Marc S. Caspe, 1089 Shoal Dr., San Mateo, Calif. 94403

[21] Appl. No.: 123,005

[22] Filed: Nov. 19, 1987

Related U.S. Application Data

[63] Continuation-in-part of Ser. No. 839,232, Mar. 12, 1986.

[51] Int. Cl.[4] ..... E04H 9/02; E04B 1/36

[52] U.S. Cl. ..... 52/167; 52/1

[58] Field of Search ..... 52/167, 1, 294

[56] References Cited

U.S. PATENT DOCUMENTS 3,638,377 2/1972 Caspe ..... 52/294

*Primary Examiner*—John E. Murtagh

*Attorney, Agent, or Firm*—Townsend & Townsend

[57] ABSTRACT

A system for protecting a building against the forces generated by an earthquake. The superstructure moves horizontally along a system of movable plates provided at the interface between the superstructure and the foundation. A sandwiched system of three levels of low friction plates lying beneath each column, interconnected by a system of clamps, restricts the movement of the columns and walls solely to a combination of orthogonal, rectilinear motions. A first set of clamps allow linear motion between the top and middle plate in a first direction and a second set of clamps allow linear motion between the middle and bottom plate in a second linear direction that is perpendicular to the first direction without torsional rotation about a vertical axis. By setting a low friction material under the top plate concentric with the column center line, no significant eccentric loads can be introduced into the column. Vertical uplift tensile forces are also significantly controlled by hold-down arms or flanges provided on the clamps.

20 Claims, 5 Drawing Sheets

EARTHQUAKE PROTECTION SYSTEM

This application is a continuation-in-part of application Ser. No. 839,232, filed Mar. 12, 1986.

This specification incorporates by reference the disclosures in the inventor's earlier granted U.S. Pat. No. 3,638,377, issued Feb. 1, 1972.

BACKGROUND OF THE INVENTION

The present invention relates to an improved system for protecting a building or equipment against damage due to earthquake forces. The invention provides a unique configuration that optimizes performance by providing a more stable configuration for the flow of stresses through the structure and the control of forces that are acting during an earthquake.

Earthquakes present a major public safety hazard to building occupants and persons on the streets below. Earthquakes also create a major economic liability for building owners and communities that depend on the continuity of building usage. Buildings and equipment must be protected against the effects of structurally damaging forces generated by the random ground movements of earthquakes. The building superstructure must be capable of responding to inertial forces due to earthquakes, yet remain stable during high wind conditions. In the inventor's previously granted patent, the contents of which are incorporated by reference, the maximum horizontal force tolerated by that earthquake protection system had a predetermined magnitude which was pre-established during design and which could not be changed after the structure had been constructed. By providing an adjustable maximum horizontal force, higher safety factors can be attained during low wind conditions that are most common.

The random motions generated by earthquakes sometimes result in forces which tend to force a twisting or torsional rotation of the superstructure about a vertical axis. Such torsional rotation causes undesirable additional relative displacement at the exterior columns and walls of the superstructure. The vertical component of earthquake forces also cause uplifting at some parts of the superstructure. These uplift forces introduce damaging impact forces once the uplift force has subsided and the lifted portions of the superstructure drop suddenly. These torsional and uplifting motions could also erode the safety factors that are utilized in calculating the design tolerances for the system.

Sequential earthquake jolts in a particular direction may result in a buildup of relative displacement of the building. Therefore, it would be desirable for an earthquake protection system to urge the building to move back towards its original position whenever possible after relative displacement has occurred. Such jolts can also cause instability in the columns of a building when the building s weight is held eccentric to the vertical axis of the columns. It is therefore desirable to maintain concentric loading in the columns.

SUMMARY OF THE INVENTION

The present invention provides a "force barrier" system for controlling the earthquake response of a building or equipment. The columns supporting the building superstructure above the foundation are restricted to combinations of orthogonal and horizontal movement to prevent significant torsional movements of the columns. The column support plates are also interlocked to prevent significant uplifting movements of the columns. The building's combination of orthogonal horizontal motion is biased back towards an original position by a passive hydraulic biasing system. Thus, the present invention provides for operational flexibility of the earthquake protection system in varying wind conditions, passively prevents undesirable torsional and uplifting movements, and urges the building towards its normal position to limit any cumulative relative displacement between the building and its foundation due to either torsional or rectilinear displacements.

The present invention provides for a direct transfer of friction damping forces through the weight supporting means by providing friction clamps on both sides of the weight supporting means. Forces are internally in equilibrium on either side of the plates and are independent of the building's weight support system since they act horizontally and are dependent only on the bolt preload and the coefficient of friction between the sliding surfaces.

Accordingly, in one form, the apparatus of the present invention comprises means for transferring the superstructure weight to the foundation which permits substantial relative horizontal movements between the superstructure and the foundation under the influence of minor horizontal forces. Control means, which are independent of the weight transferring means, transmit the predominant horizontal forces between the superstructure and the foundation. The control means have a bilinear force-deflection characteristic which substantially prevents horizontal movements between the superstructure and the foundation when subjected to a horizontal force up to a predetermined magnitude, while permitting substantial horizontal movements between the superstructure and the foundation once the horizontal force exceeds the predetermined magnitude. The force exerted by the control means during the relative movement of the superstructure is relatively constant and at least about equal to the maximum force exerted by the control means during nonmovement of the superstructure.

Broadly speaking, the present invention accomplishes these goals by separating the building superstructure from the foundation at a linkage between the columns of the superstructure, above the fixed foundation itself. For the purpose of this application, "foundation" is defined as the fixed supporting part of a structure below the sliding support plates, "Superstructure" includes that part of a building above the sliding support plates, including the framework of columns, floors and walls.

The superstructure is separated from the foundation by a series of movable support plates between the base of the superstructure and the top of the foundation, that permit horizontal motion of the superstructure at a threshold force of predetermined magnitude. One configuration of the invention includes regulating friction actuators provided to restrain each of the movable plates. A transverse holding force applied to the plates increases or decreases in accordance with the signals to vary the threshold force of the superstructure's earthquake protection system according to wind conditions or design requirements. This threshold force is the force at which the superstructure begins to have relative displacement with respect to the foundation.

The plates are confined to move in any combination of orthogonal horizontal directions. A sandwich of three plates is provided, where the top plate is fixed to the column, the bottom plate is fixed to the foundation, and the middle plate is sandwiched between the top and bottom plates. The middle plate moves in a first linear direction with respect to the top plate and a second linear direction perpendicular to the first direction with respect to the bottom plate. In this manner, the system of horizontal sliding plates passively provides a type of universal joint between the superstructure and the foundation. The plates are also confined to prevent movement in the vertical direction by an interlocking of the plates so that uplifting motion can be prevented whenever required.

The force necessary to cause movement of the plates is primarily controlled in the horizontal direction by dampers which provide resistance to the movement of the plates. The damper system consists of either frictional slide plates, hysteretic steel members or hydraulic piston members which determine the magnitude of force required to initiate movement of a plate, and the overall distance a plate can travel. The damper system serves also to dissipate a portion of the earthquake's energy. The damper system is connected only to the middle plate of each column, with the members oriented in either orthogonal direction around each column.

In addition to the damper system, a series of springs and/or hydraulic centering or biasing pistons can be used to urge the movable top and middle plates back towards their original positions by relying on reversals in direction of the ground velocities generated by the earthquake to urge the superstructure towards its original positions by introducing higher acceleration forces when the ground is pulling away from the superstructure and low decelerating forces when the superstructure is attempting to "catch up."

More specifically the invention contemplates the construction of a new building or retrofitting of an existing building with the present earthquake protection system by installing a system of stacked, horizontally movable plates beneath columns and walls of the superstructure at the foundation. A low friction lubricant surface, such as Teflon® or roller bearings, facilitates relative sliding movement between the plates. The low friction surface on the top plate is bonded concentrically with the column center line so that, when relative displacement takes place, no significant eccentric loads are introduced into the columns. The relative horizontal distances between adjacent columns and between all top, middle and bottom plates are maintained by diaphragms of rigid members which interlock the columns and each level of plates. The threshold force required to initiate relative motion between the plates is principally determined by a variable transverse force applied to the stacks of plates in conjunction with the selected damper system or combination of damper devices and springs.

Wind velocity sensing devices are provided on the exterior portion of the building. A transducer converts the wind velocity readings to generate signals which adjust the damper system force at which relative motion is initiated, such as by increasing the force applied to the particular damper device in accordance with the prevailing wind conditions.

A universal joint restricts the plates to rectilinear movement, This joint consists of the assembly of horizontal plates beneath each column which includes a top plate which has a carriage protruding from its undersurface to fit into a linear track embedded in the middle plate. This first carriage and track pair determine the direction of movement between the top and middle plate. The planar undersurfaces of the top plate and upper surfaces of the middle plate are in frictional contact and are coated with a dry lubricant such as Teflon® on the bottom of the top plate and stainless steel on top of the middle plate, or stainless steel roller bearings on stainless steel plates. A second carriage and track pair is provided between the bottom plate and the middle plate. This second carriage and track pair defines a linear direction of movement which is perpendicular to the direction of movement defined by the carriage and track pair between the top and middle plate. The planar undersurface of the middle plate and upper surface of the bottom plate are also in frictional contact with lubricant coatings or roller bearings.

The tracks provided in the plates are provided with longitudinally extending flanged edges to prevent any relative vertical displacement between plates. This prevents the column from lifting up and away from the foundation. Such uplift forces could cause harmful impact loads when the force subsides and the column suddenly impacts the foundation. Thus, the assembly of plates significantly prevents both torsional and uplifting forces.

The middle movable plates can be biased towards their original position by a completely passive system of hydraulic biasing pistons arranged in either orthogonal direction. A cylindrical chamber filled with the hydraulic fluid is connected to each middle plate and fitted with a piston to reciprocate in the direction in which the plate moves and a neoprene or rubber cradle under the chamber, that connects it to the foundation and acts as a spring in that direction. The head of the piston is a plate provided with control valves to allow fluid to pass from one side of the piston head to the other or through piping that links the opposite chambers. Under normal conditions, the piston head is located at a zero position within the cylindrical chamber. The chamber is designated as having a "right" end through which the piston arm enters, and a "left" end which is closed and opposite the right end. The zero position is located somewhere between the left and right ends. The one or more control valves (in the piston head or in the piping) are set to open at predetermined pressures corresponding to the force on the piston arm at which relative displacement is initiated by earthquake movements and to maintain that force by opening further whenever the relative velocity increases.

Two liquid flow circuits are provided to circulate the fluid within the left and right chambers. An opening is provided through the chamber wall at or near the zero point, so that no flow goes through the circuits until the opening is crossed over by the piston head when it is moved away from the normal position. The normal position of the piston head defines a left chamber and a right chamber corresponding to the left and right ends of the chamber. The left flow circuit circulates fluid from the zero point opening to the left chamber to bias the piston head away from the left chamber towards the zero point, while a right flow circuit analogously biases the piston head away from the right chamber towards the zero point.

Thus, the present invention prevents damage to the building by permitting controlled and adjustable relative movement between the building superstructure and the foundation in varying wind conditions. Relative displacement is only permitted in the horizontal direction and no significant torsional rotation is permitted. Cumulative displacement is significantly prevented by a hydraulic centering system that urges the superstructure back towards center. Eccentric loads on the columns are avoided and all columns are rigidly interconnected by diaphragms, With the exception of the wind adjustment system, the entire system is completely passive. so that power failures which commonly accompany earthquakes have no effect on the operation of the building's protection system. Thus, damage to the building and its occupants are minimized.

DESCRIPTION OF THE PREFERRED EMBODIMENT

Figure 1A:
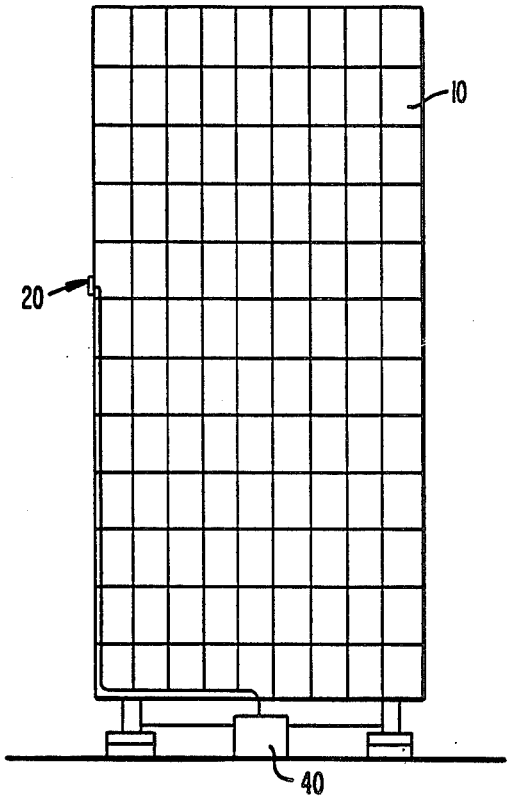
FIG. 1A is a schematic illustration of a building equipped with apparatus for adjusting the earthquake response of the building according to wind conditions.
Figure 1B:
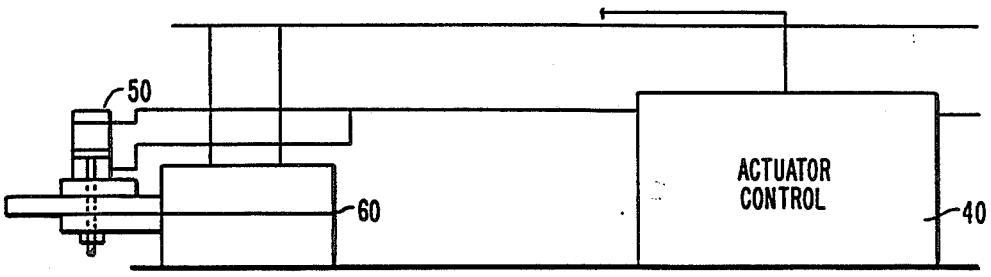
FIG. 1B is a detail from FIG. 1A which shows a schematic of the adjusting mechanism.

FIGS. 1A and 1B schematically illustrate the apparatus for adjusting the earthquake protection system to compensate for varying wind conditions. In the preferred embodiment, the building's superstructure and foundation are interconnected by a system of horizontally disposed movable friction interface which permits relative horizontal motion between the foundation and the superstructure when the magnitude of the horizontal forces generated by an earthquake exceed a threshold transverse load applied to the interface. By varying the transverse load, the horizontal reaction of the building can be controlled to adjust for changing wind conditions. In high wind conditions, the threshold force would be increased to prevent the building from moving along the interface.

A typical building 10 as shown in FIG. 1A has at least one wind sensor 20, in each orthogonal direction, mounted on an external surface where it is likely to encounter high wind velocities. The wind sensor 20 is a transducer which reads wind velocities and translates the velocities into signals, typically electrical signals, which are transmitted to an actuator control 40. The actuator controller 40 is linked to transverse loading means, typically a hydraulic piston 50 which accordingly increases or decreases the transverse load applied to frictional interfaces 60. The controller is designed to increase the transverse load applied by the piston 50 when it receives signals indicating a condition of high wind velocities, so that movement along the friction interfaces 60 is not initiated by gusts of strong wind. Conversely, the actuator control 40 reduces the transverse loading on the interfaces when the wind conditions are more typical. In this manner, the response of the structure to wind conditions can be continuously monitored and controlled.

Figure 2:
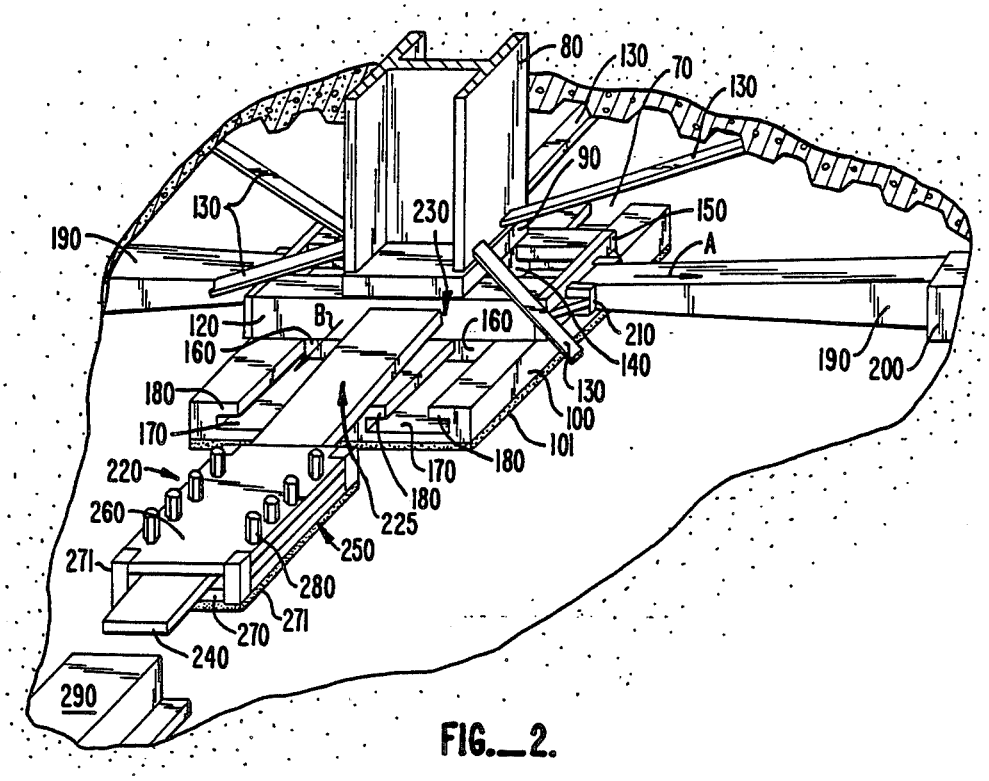
FIG. 2 is a perspective view of a column equipped with the apparatus of the earthquake protection system.

FIG. 2 illustrates the plate assembly 70 at the base of a typical column 80 at the foundation of the building. The superstructure of the building is separated from the foundation by the plate assembly 70 which consists of a stacked series of plates—top plate 90 which is fixed to the bottom of the column 80, bottom plate 100 which is essentially fixed to the foundation or a floor above the foundation 110 and a middle plate 120 sandwiched between the top and bottom plates. To separate the superstructure from the foundation, the combination of the plates are movable in any horizontal direction to accommodate the random movements generated by earthquakes. To assure that the columns of the superstructure do not experience an eccentric load that could cause column instability under the weight of the building, the underside of the top plate 90 is coated with a lowfriction surface that is concentrically bonded to the column at its center line. thereby permitting it to slide on the larger stainless steel top surface of the middle plate 120 without introducing eccentricity into the column.

To assure that the building's superstructure moves as a single unit, adjacent column in the building's array of columns are linked by interlocking diaphragm struts 130 which rigidly maintain the distances between adjacent columns 80. To assure that the superstructure does not rotate significantly in the plane of the relative movement, the adjacent middle plates under the array of columns can also be linked by interlocking diaphragm struts 130 which rigidly maintain the distances between adjacent middle plates 120.

Relative movement between the superstructure and the foundation is preferably confined to motions in the horizontal direction only. Due to the vertical and rotative forces generated by earthquakes, columns at portions of the superstructure may be subjected to torsional rotation about some vertical axis. Such a twisting or torsional rotation is undesirable because it creates exaggerated displacements at the corner columns of the superstructure. The vertical component of movement due to earthquake forces is also harmful since it may cause an uplift at some columns, thereby separating the column from the substructure. Damage may result when the uplifting force subsides and the column falls suddenly on the foundation thereby generating substantial impact forces. Reactive forces at other columns of the building are also introduced to oppose the uplift forces. The torsional forces are transmitted by the plate assembly through an interlocking in the horizontal direction of the tracks and carriages of the top, middle and bottom plates. These uplifting forces are transmitted by the plate assembly through an interlocking in the vertical direction of the top, middle and bottom plates.

To resist any torsional rotation the plate assembly is confined to horizontal orthogonal movement. The top plate 90 is limited to linear motion with respect to the middle plate 120 in a first direction designated by the arrow A. A carriage having an inverted T-shaped cross-section 140 protrudes from the underside of top plate 90 and slidingly engages a complementary-shaped track 150 embedded in the middle plate 120. The middle plate 120 is restricted to horizontal movement with respect to bottom plate 100 in the direction designated B. One or more carriages 160 protrude from the undersurface of the middle plate 120 to slidingly engage complementary-shaped tracks 170 provided on the upper surface of the bottom plate 100. Direction A is perpendicular to direction B. By the cooperation of the three plates along the track and carriage pairs, a universal range of motion in the horizontal direction is permitted. The bottom plate 100 is mounted to the foundation atop neoprene shear spring 101. These resilient shear springs afford the mounting of the movable plate assembly some flexibility, thereby controlling the initial stiffness of the biasing pistons during an earthquake.

Vertical movement of the track and carriage pairs is prevented by the flanged edges 180 which extend longitudinally along the tracks 170 and 150. These flanged edges 180 form upper stop members against the carriages which ride along their respective tracks. All contacting surfaces between the plates must be coated with a lubricant, preferably Teflon ®or roller bearings so that frictional losses are reduced.

Figure 3:
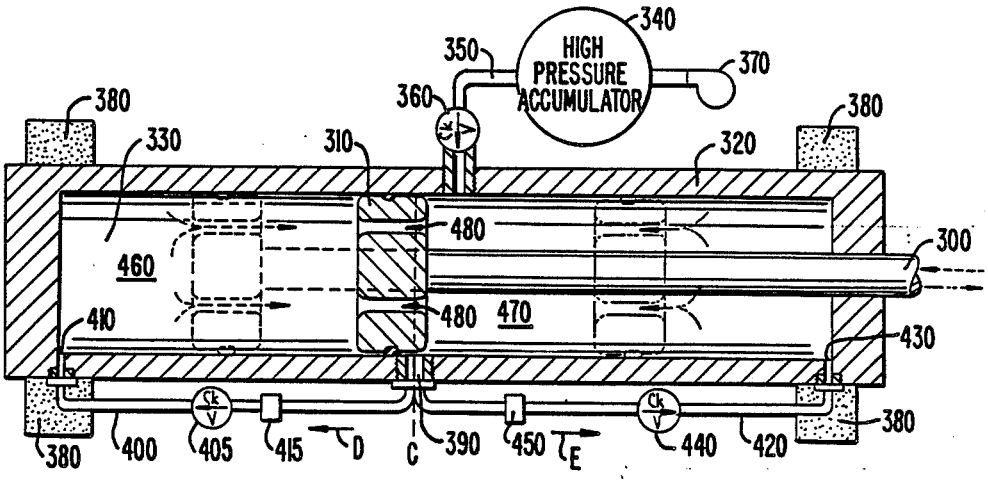
FIG. 3 is a cross-sectional diagram illustrating a biasing piston.

In addition to the transverse loading means 280 used for adjusting the friction interfaces between the plates of the plate assembly 70 for varying wind conditions, an additional damper system is provided to further control horizontal motion of the plates. Two different types of damper devices are illustrated in FIGS. 2 and 3. In FIG. 2 a hysteretic damper consists of a member 190 extending from a pinned connection 210 to the middle movable plate and terminating in a fixed mount 200 connecting it to the foundation. The member 190 has a cross-section of varying width to provide controlled inelastic strain in the member as the middle plate moves in the direction perpendicular to the axis of the member. The varying width provides a constant stress gradient so that inelastic strains can be distributed over a greater length of the member 190. An alternate embodiment of the hysteretic damper is shown on FIG. 4 wherein a simple beam 500 is connected to the middle plate 120 at two points. resulting in a constant length middle span 510 that distributes inelastic strains over that entire middle span without changing the member width. Adjustment of the damper span length can provide varying force levels for varying wind conditions.

Figure 5:
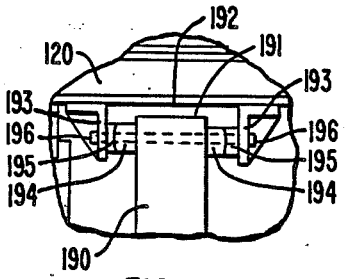
FIG. 5 is a detailed top view of the linkage between a hysteretic beam and a middle plate.

In the detailed view of FIG. 5, the linkage between the hysteretic member 190 and middle plate 120 is shown. The terminal end 191 is mounted in a joint which permits movement along the longitudinal axis of member 190 in the direction indicated by the arrow A (FIG. 2). The end 191 is also spaced apart from middle plate wall 192 to permit a degree of movement towards middle plate 120. The hysteretic beam is typically constructed of mild carbon steel, and is pinned in place between two L-shaped flanges 193 fixed to middle plate 120 and contacting member 190 at two Teflon ® coated pads 194. The Teflon ® coated pads have rounded ends nearest the flanges which are compressed against concave stainless steel sockets 195 which permit a degree of rotative movement. The flanges. Teflon ® coated pads and sockets are in a linear arrangement transverse to the longitudinal axis of member 190. with a compressive load applied by precompression rods 196.

Figure 4:
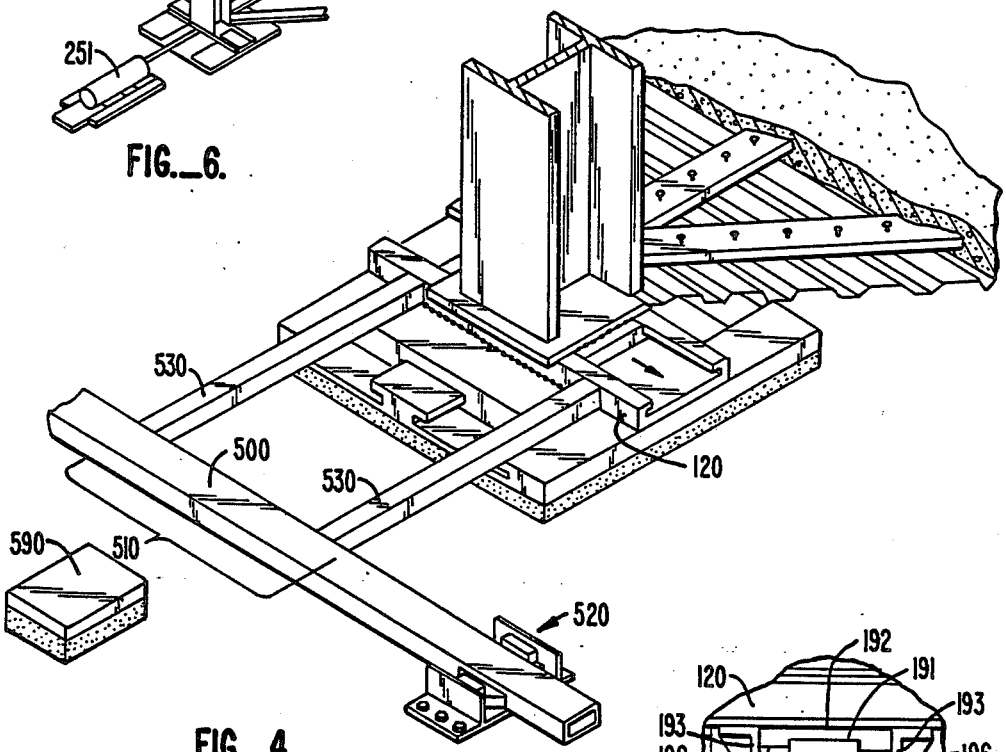
FIG. 4 is a perspective view of an alternative embodiment of a hysteretic damper device.

A linkage similar to that shown in FIG. 5 may be used on the embodiment of the hysteretic damper shown in FIG. 4. The pin support assembly 520 may be used to vary the span length of the beam 500 to respond to varying wind conditions.

A second type of damper is the friction damper 220. An arm 225 extends from the fixed mount 230 at the movable plate to a free end 240. The arm 225 is longitudinally movable in the direction of movement of the middle plate to which it is attached. The free end 240 passes through a prestress assembly 250 which applies a compression force to the arm 225 and determines the resistance force applied to the arm 225. The prestress assembly 250 is basically an upper plate 260 and a lower plate 270 which are spaced apart a predetermined distance through which the cantilever arm is free to move. Jacks or nuts 280 may be used to tighten the plates 260 and 270 together to increase the frictional force applied to the arm 225. which can have an adjustable pressure for wind conditions. The top plate 260 is laterally restrained by lugs 271 that protrude upwards from bottom plate 270 as guides. The bottom plate 270 is mounted to the foundation on a resilient shear spring 274 to control the initial stiffness of the friction damper. The overall distance of travel of arm 225 is limited by a stop member 290 which is mounted to the foundation a distance from the end 240 of arm 225. Preferably, the stop member 290 is a spring constructed of a resilient material such as neoprene.

Figure 6:
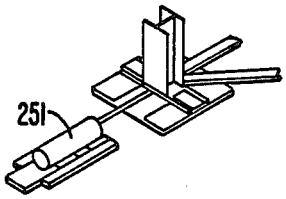
FIG. 6 is a perspective view of the exterior of a piston damper.

As an alternative to the pre-stress assembly, an hydraulic piston damper 251 and chamber (FIG. 6) might also be substituted as the damper. A piston damper can also have an adjustment for wind forces by adjusting the control valve settings of the piston to adjust the hydraulic response of the damper device.

The design of the plate assembly 70 is such that the dimensions of the plates are sufficient to accommodate relative displacement well within a predetermined safety factor. Although earthquake movements are generally random. there is some chance that the movement might produce cumulative affects which would result in total displacements which are greater than anticipated. To prevent such accumulations of displacement, it is desirable to bias the movable plates back towards their original positions. One or more of the biasing pistons. such as the one illustrated in FIGS. 3 and 4, may be linked to each middle movable plate to produce such a biasing effect. Each installed biasing piston is arranged to oppose the direction of the movement of the movable plate to which it is linked. It would be known to one skilled in the art how to connect the piston arm 300 to the middle movable plates, therefore such a linkage is not illustrated. The piston arm 300 terminates in a piston head 310 which moves reciprocably through a cylindrical piston chamber 320. The chamber 320 is filled with a hydraulic fluid 330. As a matter of convention, the end through which the piston arm 300 enters the chamber is designated the "right" end while the opposite closed end is designated the "left" end.

The fluid pressure in the chamber is maintained by an external accumulator tank schematically illustrated and identified by the numeral 340. The accumulator tank 340 is maintained at high pressure and is connected to the chamber 320 along a line 350 which has a one-way valve 360 directing flow into the chamber if the pressure falls below a predetermined minimum pressure level. A pump 370 activates to provide the motive force to force the fluid into the accumulator tank and keep it charged. Failure of the pump or its power system has no effect on the biasing effect of the system.

The chamber 320 is mounted to the foundation atop neoprene shear springs 380. These resilient shear springs afford the mounting of the chamber on the foundation some flexibility. thereby controlling the initial stiffness of the biasing pistons during an earthquake.

In a non-earthquake situation, the piston head remains at a zero position designated by the letter C. Two openings 390 are provided in the chamber wall at or near the zero position. The piston head 310 is the valve which crosses over the opening 390 before flow can begin in either flow circuit. It is in the non-earthquake position when it is located at the zero position in the chamber. A left flow line 400 connects the opening 390 at the zero position with the left end of the left chamber at an opening 410. The line 400 is provided with a check valve 405 which opens only in the direction indicated by the arrow D of fluid flowing from the zero position towards the left end. A control valve 415 is also provided on the line between the zero position and the check valve. The right flow line 420 is similarly provided to connect the zero position 390 and the right end of the chamber at an opening 430. A check valve 440 which opens only in the direction of flow indicated by the arrow E from the zero position towards the right end of the chamber directs the fluid flow, and a control valve 450 between the zero position and the check valve. The direction of flow at any instant of time is dependent on both the relative position of the piston with respect to line C and the relative velocity between the piston which is attached to the superstructure. through the middle plate, and the chamber which is attached to the foundation.

The longitudinal thickness of the piston head 310 divides the chamber 320 into a left chamber 460 and a right chamber 470 on either side of the zero position 390. A plurality of control valves 480 in the piston head open and close at predetermined pressures to regulate fluid flow through the piston head from one chamber to the other. Multiple control valves may be arranged to open at increasing pressures to limit the maximum velocity of the fluid through the piston, or a single control valve could be used to modulate the flow.

Figure 7:
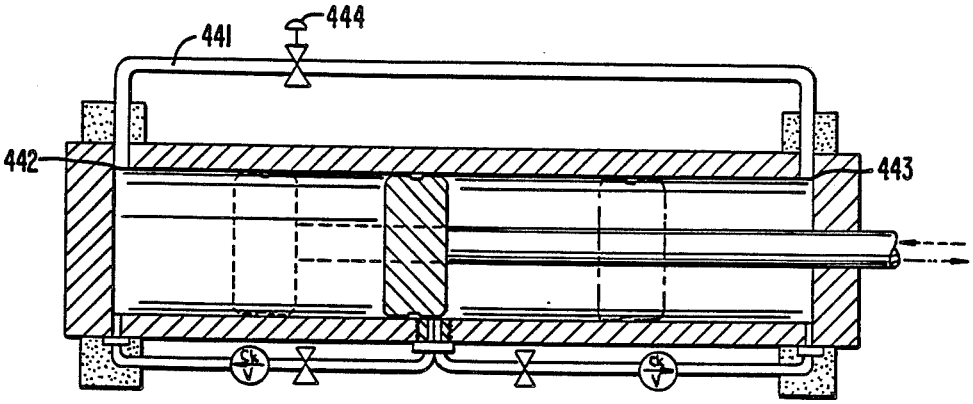
FIG. 7 is a cross-sectional diagram illustrating another embodiment of a biasing piston.

In an alternative embodiment (FIG. 7), the control valves in the piston head can be eliminated with a flow line 441 connecting the left end 442 and the right end 443 as a substitute to accommodate flow from one chamber to the other. Control valve 444 disposed along the line 441 is set to open at a predetermined pressure.

Four fluid flow conditions in the biasing pistons are possible. The first fluid flow condition is defined as the situation in which the piston head 310 moves to the left of the zero position 390 towards the left end of the chamber. Under this condition, the resistance against movement of the plate is afforded by the hydraulic fluid 330, and fluid flow is solely determined by the control valves 480 i the piston head. Control valves 480 open according to their design settings to allow fluid to pass from the left chamber to the right chamber. No fluid flows through either fluid flow circuit. No fluid flows through line 420 since both its inlet 390 and outlet 430 are on the same side of the piston head. No fluid flows through line 400 since the check valve 405 does not open in the direction of flow from the outlet 410 to inlet 390.

The second flow condition exists when the piston head is within the left chamber and moving towards the zero position. This flow condition is shown in broken lines in left chamber 460. This situation occurs once the foundation velocity reverses itself with respect to the superstructure to pull the piston arm towards the right end of the chamber. Under this flow condition. the movement of the piston head causes a pressure buildup in the right chamber which forces fluid through the left fluid flow circuit from at or near the zero position 390 towards the left end opening 410 after passing through the left pressure reducing valve 415 and check valve 405. This additional flow of fluid through the left fluid flow circuit reduces the pressure on the piston, thereby reducing the decelerating force and urging the superstructure to slide back towards its zero position more rapidly.

The third flow condition is defined as the scenario in which the piston head 310 is moving away from the zero position towards the right end of the chamber. Analogous to the first flow condition, the resistance afforded by the fluid is defined solely by the settings of control valves 480 in the piston head. No fluid flows through either fluid flow circuit.

As the relative velocity between the foundation and the superstructure reverse direction, the fourth flow condition is presented. The piston head 310 moves from a position within the right chamber towards the zero position as shown in phantom lines in chamber 470. Fluid is forced through the right fluid flow line 420, passing through control valve 450. opening the right check valve 440. and urging the piston head back towards the zero position as described above in the second flow condition.

Figure 8:
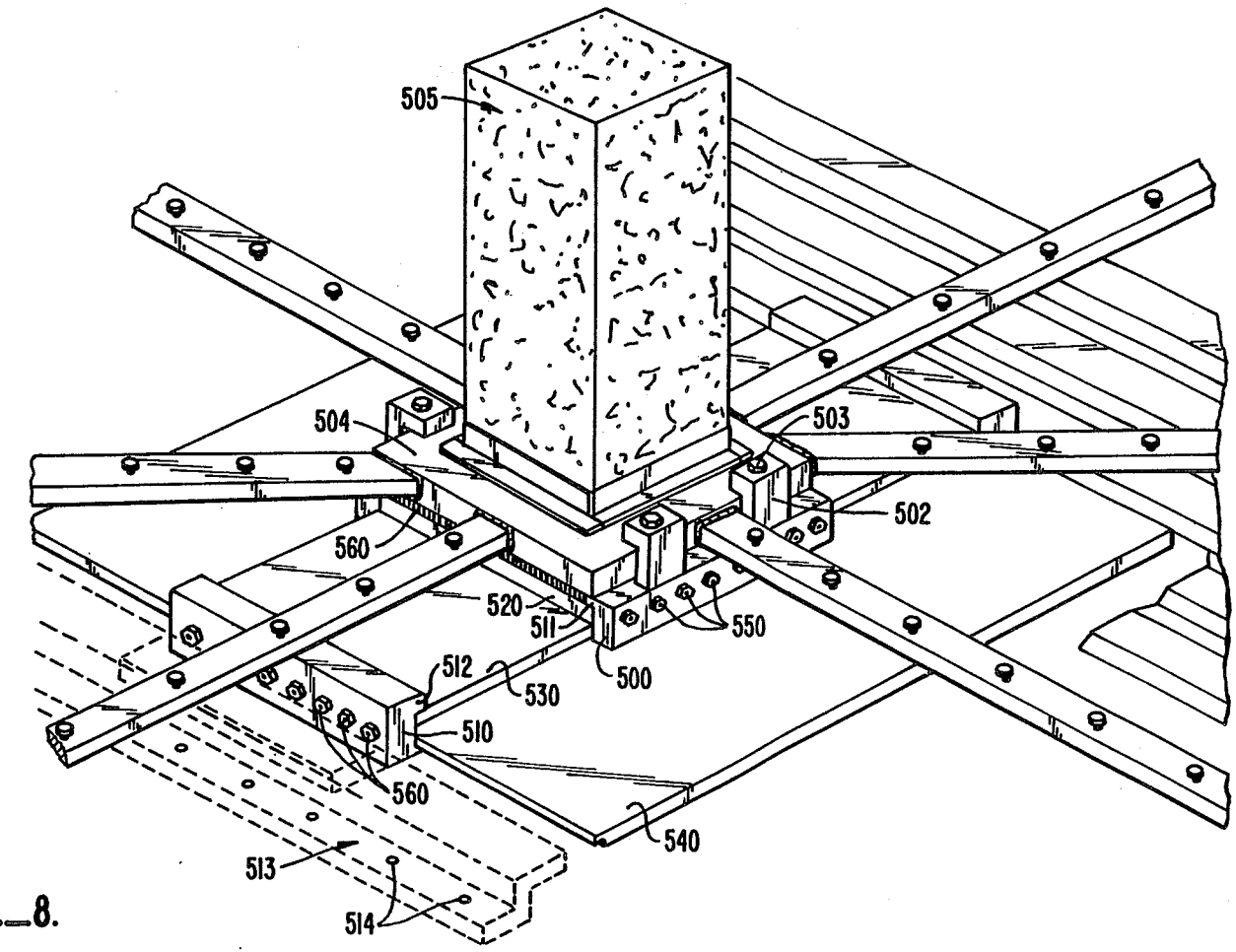
FIG. 8 is a perspective view of a column equipped with an alternative embodiment of the invention equipped with friction control clamps.
Figure 9:
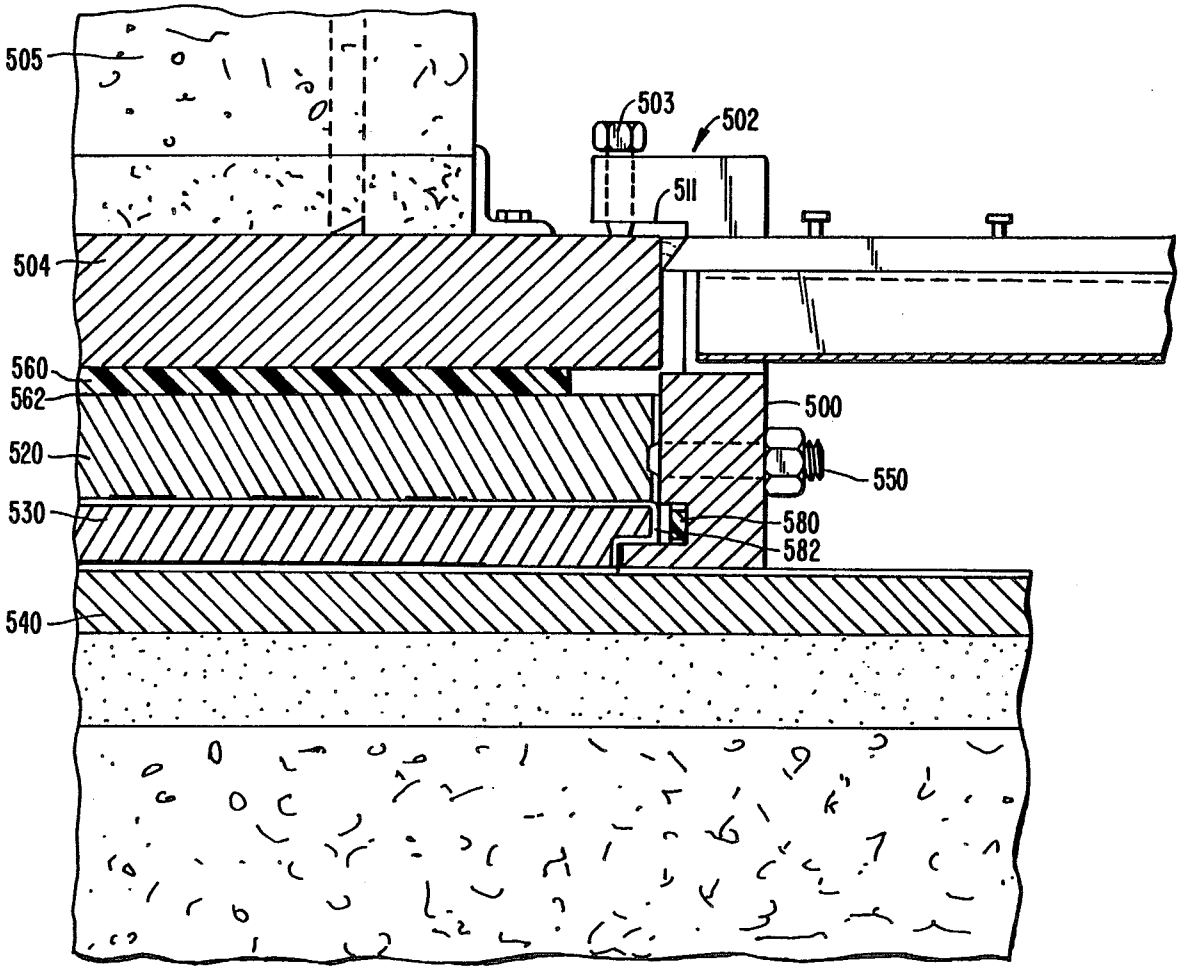
FIG. 9 is a cross-sectional diagram illustrating the top and middle plate details of the embodiment illustrated in FIG. 8.

FIGS. 8 and 9 illustrate an alternative embodiment for the friction damper 225. In this embodiment, the clamps 500 and 510 vertically restrain the top, middle and bottom plates (520. 530 and 540) and exert a force which is predetermined by the torque applied by bolts 550 and 560.

Clamps 500 (one of the pair is not shown) are fixedly mounted to the upper surface of bottom plate 540, direct the movement of middle plate 530, and vertically confine the top plate 520 and middle plate 530. In situations where uplift forces are of concern, clamp 500 may include a hold-down arm 502 with an adjustable bolt 503 bearing down on sole plate 504 underneath of column 505. The top. middle and bottom plates 520, 530 and 540 support the weight of the column. while clamps 500 and 510 are independent of the weight support system. Hold-down arm 502 prevents column 505 and sole plate 504 from lifting upwardly away from top plate 520. To some extent, the horizontally extending flanges 511 and 512 of clamps 500 and 510 also prevent vertical uplift. By transferring uplift forces to the hold down clips 513 and into the foundation through bolts 514.

Bolts 550 threaded through clamps 500 bear against a high friction. dry lubricant (such as Merriman Corporation's G-12 lubricant) and against the stainless steel track (not shown) dispersed along the edge of the middle plate 530. By controlling how tightly the bolts 550 bear against plate 530. the friction drag force between the plates 520. 530 and clamps 500 with the track on the side of 530. can be predicted and calibrated to conform to the predetermined magnitude of earthquake force in the orthogonal direction defined by the clamps that is compatible with the building's tolerance for forces and movement in that direction.

Similarly, clamps 510 are fixedly mounted to the upper surface of the foundation beneath bottom plate 540, direct the movement of bottom plate 540 in a direction perpendicular to the movement of middle plate 530, and clamp together middle and bottom plates 530, 540. Bolts 560 are tightened to control the friction drag force along the sides of plate 540 and clamps 510 in a direction perpendicular to the direction of movement defined by clamps 500.

As in previous embodiments. the surfaces of the top, middle and bottom plates are alternately surfaced so that Teflon ® contacts stainless steel. Thus, the clamps 500 and 510 provide adjustable brake shoes for movement of the plates in orthogonal directions. Rubber bearing 570 is provided between top plate 520 and sole plate 504 in order to provide a self-levelling mechanism and to establish the initial (non-sliding) stiffness of the assemblage.

Rubber friction bearing 580 bears against sliding surface 582 to mitigate any serious loss of bearing pressure on the sliding surfaces due to inelastic creep or relaxation of the steel plate and its bolts after they are calibrated and installed.

Clamps 500 and 510 serve other purposes as well. The horizontal flanges 511 and 512 of clamps 500 and 510 respectively, can transmit uplift tensile forces from the column 505 to the foundation below. by transferring the uplift forces from plate to plate to plate. Wherever needed. hold-down clips 513 (shown in broken lines in FIG. 8) may also b provided to control uplift between the middle plate 530 and the foundation.

Because the engaging surfaces are coated with low friction material (such as Teflon ®), little change in sliding resistance is developed and no significant change in bearing pressure occurs on the sliding surfaces. The uplift engaging flanges 511 and 512 and hold-down arms 502 can be omitted at columns where no uplift tension is anticipated.

Horizontal flanges 511 and 512 also serve to restrain against rotation of clamps 500. 510 due to any twisting forces that may be exerted on the columns.

The apparatus of the earthquake protection system can easily be installed in an existing building having a conventional foundation. The system is extremely reliable due to its stability, controllability and simplicity in design, construction and operation. The entire assemblage can be housed between an existing floor system and a new floor system with a floor-to-floor dimension of approximately 10 to 14 inches. These floor systems can provide both high levels of fireproofing protection and access for inspection. In the case of a newly constructed building. the system of the present invention is relatively inexpensive to install, when compared to the presently-used systems, and could be less expensive because of cost savings in the superstructure.

The foregoing is a complete description of the invention. but is not intended to limit the scope of the invention. except as stated in the appended claims. Variations of the devices disclosed herein may be used in combination to provide a customized system of earthquake protection for a structure. For instance, the hydraulic piston dampers might also serve as biasing pistons for a column. as well as adjusting the threshold force of the column to wind conditions. While the above provides a full and complete disclosure of the preferred embodiment of the invention. various modifications, alternate constructions and equivalents may be employed without departing from the true spirit and scope of the invention.

What is claimed is:

1. Apparatus for adapting the earthquake response of a building superstructure. wherein the building superstructure includes an array of columns and walls supporting the building above the foundation, said apparatus provided between the base of each column and the foundation, comprising:

a top plate, a middle plate and a bottom plate in a vertically stacked, three-level arrangement, wherein said top plate is fixedly mounted with respect to the base end of a column. and said bottom plate is fixedly mounted to an upper surface that is connected to the foundation which is centered directly below said top plate at a normal position, with said middle plate sandwiched between said top plate and said bottom plate, contacting surfaces of said plates being provided with a low-friction lubricant, said top, middle and bottom plates further comprising:

means for guiding horizontal movement of said plates relative to one another, said guiding means constraining said top plate to horizontal linear movement in a first direction with respect to said middle plate and said guiding means further constraining said middle plate to horizontal linear movement with respect to said bottom plate in a second direction that is perpendicular to said first direction, said guiding means comprising:

a first set of clamps fixedly mounted to the upper surface of said bottom plate, for permitting relative sliding movement of said top plate with respect to said middle plate restricted to said first direction; and a second set of clamps fixedly mounted to a surface below said bottom plate for permitting relative sliding movement of said middle plate with respect to said bottom plate restricted to said second direction.

2. The apparatus of claim 1, wherein said low-friction lubricant comprises a coating of tetrafluoroethylene on stainless steel.

3. The apparatus of claim 1, wherein said low-friction lubricant comprises an array of ball bearings.

4. The apparatus of claim 1, wherein said top plate further comprises a low-friction lubricant surface that is bonded concentrically to the column center line so that when relative displacement between the foundation and the superstructure takes place, no significant eccentric loads are introduced into the columns.

5. The apparatus of claim 1, wherein said bottom plate further comprises a neoprene pad fixedly mounted under said bottom plate.

6. The apparatus of claim 1, further comprising uplift stops, wherein said uplift stops prevent the columns from lifting vertically away from the foundation.

7. The apparatus of claim 6, wherein said uplift stops comprising horizontally extending flanges provided on said first and second clamps to prevent their respectively confined plates from vertical uplift.

8. The apparatus of claim 6. wherein said first set of clamps further comprise hold down arms to prevent relative vertical movement between said top plate and its respective column.

9. The apparatus of claim 1. wherein said plate assembly further comprises dampers to regulate horizontal movement of said plate assembly.

10. The apparatus of claim 9, wherein said dampers comprise hysteretic beams having two ends, said hysteretic beams connected at one end to said middle plate and connected at the opposite end to the foundation, said hysteretic beams mounted to extend radially from said middle plate, shaped to bend elastically until the application of a predetermined threshold force and bending inelastically once the predetermined threshold force has been exceeded.

11. The apparatus of claim 9, wherein said dampers comprise an arm radiating from a fixed mount on said middle plate. with a free end passing through a prestress assembly fixedly mounted to said foundation such that said prestress assembly exerts a predetermined frictional force on said arm to resist longitudinal movement of said arm and middle plate.

12. The apparatus of claim 11, wherein said prestress assembly comprises a second upper plate and a second lower plate mounted to said foundation in a vertically stacked arrangement. spaced apart a predetermined distance wherein said cantilever arm extends through and between said second upper plate and said second lower plate. wherein said predetermined distance between said second upper and said second lower plate determines the transverse load applied by said friction dampers that must be overcome by the cantilever arm in order for said middle plate to move.

13. The apparatus of claim 11. further comprising flexible stop members fixedly mounted to the foundation opposite said dampers to limit the distance of travel of the free end of said arm.

14. The apparatus of claim 11 further comprising a flexible shear spring pad fixed beneath each said dampers and above the foundation. whereby shear forces are permitted to be transferred through said arm with a predetermined stiffness to assure that said dampers and said movable plates are displaced at approximately the same time.

15. The apparatus of claim 1 further comprising a first diaphragm, a second diaphragm, and a third diaphragm. said diaphragms rigidly connecting said columns and transferring forces between said columns, wherein:

said first diaphragm comprises interconnecting fixed length struts horizontally linking each said top plate to each adjacent top plate;

said second diaphragm comprises interconnecting fixed length struts horizontally linking said middle plates disposed beneath each said column to each adjacent middle plate of adjacent column; and said third diaphragm comprises a floor supporting said bottom plates.

16. Apparatus for adapting the earthquake response of a building superstructure, wherein the building superstructure includes an array of columns and walls supporting the building above the foundation, said apparatus provided between the base of each column and the foundation. comprising:

a top plate, a middle plate and a bottom plate in a vertically stacked, three-level arrangement, wherein said top plate is fixedly mounted with respect to the base end of a column. and said bottom plate is fixedly mounted to an upper surface that is connected to the foundation which is centered directly below said top plate at a normal position. with said middle plate sandwiched between said top plate and said bottom plate. contacting surfaces of said plates being provided with a low-friction lubricant. said top. middle and bottom plates further comprising:

means for guiding horizontal movement of said plates relative to one another. said guiding means constraining said top plate to horizontal linear movement in a first direction with respect to said middle plate and said guiding means further constraining said middle plate to horizontal linear movement with respect to said bottom plate in a second direction that is perpendicular to said first direction, said guiding means comprising:

a first set of clamps fixedly mounted to the side surface of said top plate, for permitting relative sliding movement of said top plate with respect to said middle plate restricted to said first direction, said first set of clamps horizontally and vertically confining said top and said middle plates with a predetermined drag force; and a second set of clamps fixedly mounted to the side surface of the middle plate for permitting relative sliding movement of said middle plate with respect to said bottom plate restricted to said second direction, said second set of clamps horizontally and vertically confining said middle and said bottom plates with a predetermined drag force.

17. The apparatus of claim 16, wherein said first set of clamps further comprise hold down arms to prevent relative vertical movement between said top plate and the foundation.

18. The apparatus of claim 16 wherein said first set of clamps further comprises horizontal flanges which extend over said top plate and said second set of clamps further comprises horizontal flanges which extend over said middle plate. wherein said horizontal flanges restrict vertical uplift of said top and middle plates respectively.

19. The apparatus of claim 16, further comprising hold-down clips secured to a surface beneath said bottom plate. said hold-down clips restricting vertical uplift of said bottom plate.

20. The apparatus of claim 16. wherein each of said first set of clamps further comprises hold-down arms which restrict vertical uplift between each said top plate and its respective column.

* * * * *